US005395080A

United States Patent [19]

Smith

[11] Patent Number: 5,395,080

[45] Date of Patent: * Mar. 7, 1995

[54] REMOVABLE HANGER

[76] Inventor: Harold C. Smith, 1101 Birchcrest Rd., Bellevue, Nebr. 68005

[ * ] Notice: The portion of the term of this patent subsequent to Jan. 26, 2010 has been disclaimed.

[21] Appl. No.: 77,291

[22] Filed: Jun. 15, 1993

[51] Int. Cl.[6] ..... A47B 96/06

[52] U.S. Cl. ..... 248/215; 47/39; 47/67; 248/304; 248/312.1

[58] Field of Search ..... 248/215, 214, 304, 312.1, 248/314, 340, 27.8; 47/39, 67

[56] References Cited

U.S. PATENT DOCUMENTS

| | | | |
|---|---|---|---|
| D. 279,450 | 7/1985 | Chad | D8/363 |
| D. 296,760 | 7/1988 | McGrath | 248/312.1 X |
| D. 300,302 | 3/1989 | Possemato | D8/367 |
| 829,239 | 8/1906 | Thompson et al. | 248/215 |
| 895,047 | 8/1908 | Schraudner | 248/215 X |
| 1,036,945 | 8/1912 | Wilkerson . | |
| 1,333,692 | 3/1920 | Wester . | |
| 2,625,353 | 1/1953 | Henry | 248/48.2 |
| 3,043,546 | 7/1962 | Reich | 248/215 |
| 3,260,489 | 7/1966 | Hentzi | 248/215 |
| 3,854,689 | 12/1974 | Engels | 248/340 |
| 4,258,893 | 3/1981 | Tolley | 248/214 X |
| 5,037,051 | 8/1991 | Moriello | 248/215 |
| 5,074,504 | 12/1991 | Minnick | 47/67 X |
| 5,094,417 | 3/1992 | Creed | 248/215 |
| 5,118,059 | 6/1992 | Mainer | 248/215 |
| 5,149,036 | 9/1992 | Sheehan | 248/215 |
| 5,181,683 | 1/1993 | Smith | 248/227 |
| 5,199,678 | 4/1993 | Luebke | 248/214 X |

*Primary Examiner*—Ramon O. Ramirez

*Attorney, Agent, or Firm*—Zarley, McKee, Thomte, Voorhees & Sease; Mark D. Frederiksen

[57] ABSTRACT

A hanger for removable engagement with a support member includes a rigid body with a hook-shaped upper end and a lower end having a removable support attachment for supporting an article on the hanger.

7 Claims, 3 Drawing Sheets

REMOVABLE HANGER

TECHNICAL FIELD

The present invention relates generally to removable or detachable hooks and hangers, and more particularly to an improved removable hook which may be detachably mounted on a dimensional lumber support member, and which has a removable attachment thereon for supporting articles such as hanging plants, plant pots, and the like.

BACKGROUND OF THE INVENTION

With the popularity of plants for decorative and landscaping purposes, people often desire to decorate outside patios and decks by hanging potted plants. Due to the weight of the potted plants, hanging the plants is often difficult and unreliable. Typically, potted plants are hung on overhead beams or support members by drilling a hole and directly inserting a screw hook into the wood and hanging the pot by the screw hook. Because of the weight of the potted plant, the screws can become loose and dislodged.

Another problem with inserting a screw hook directly into the wood is that it leaves a permanent hole in the wood.

Still another problem with the conventional screw hook is that it is often not convenient to move the location of the plant because this requires removing the screw hook and inserting a new screw hook at another location.

SUMMARY OF THE INVENTION

It is therefore a general object of the present invention to provide an improved removable hanger for hanging potted plants on overhead beams, handrails, and other support members.

Yet another object of the present invention is to provide a removable hanger that leaves no permanent holes or marks in the wood.

Yet another object of the present invention is to provide a removable hanger that is easily moved from one location to another.

Still another object is to provide a removable hanger with detachable accessories for supporting various different types of articles, such as flower pots and hanging plants.

These and other objects of the present invention will be apparent to those skilled in the art.

The hanger of the present invention includes a rigid body with a hook-shaped upper end adapted for removable attachment to the top surface of a support member and a lower end having a removable attachment for supporting various types of articles, such as hanging plants, flower pots, and the like.

DESCRIPTION OF THE PREFERRED EMBODIMENTS

Figure 1:
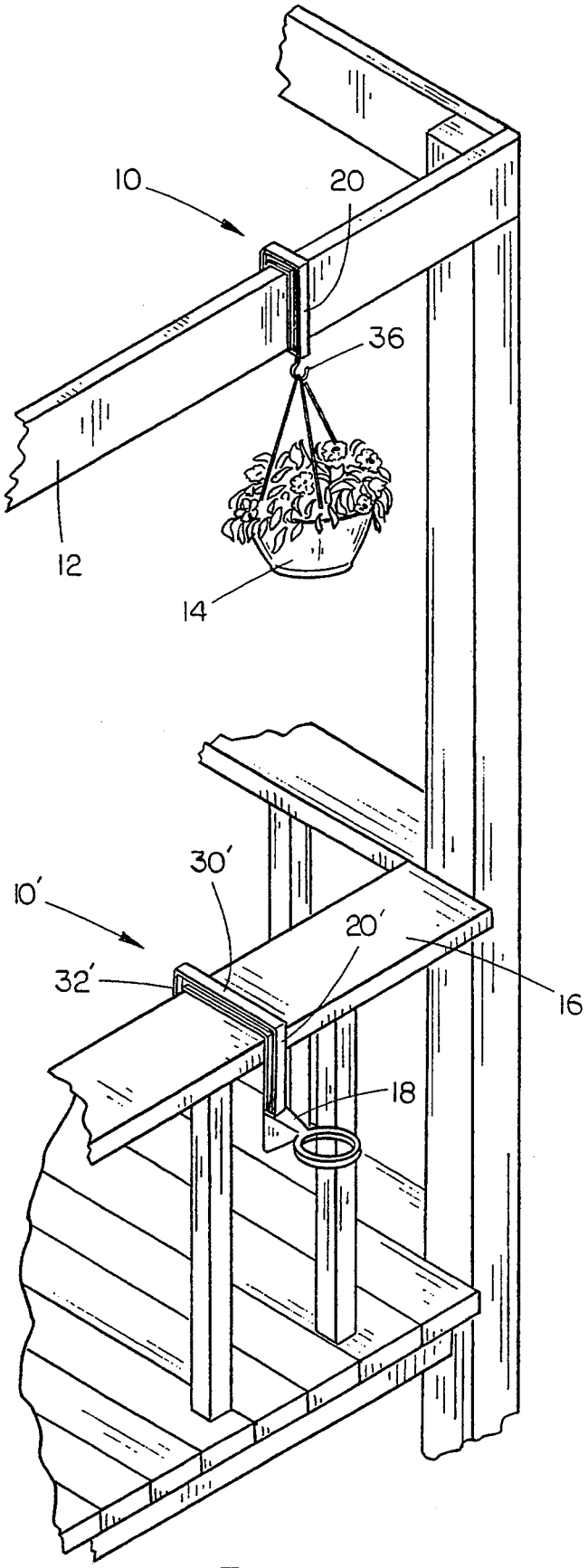
FIG. 1 is a perspective view of one embodiment of the present invention installed on a support beam and a second embodiment on a handrail.

Referring now to the drawings, in which similar or corresponding parts are identified with the same reference numeral, a first embodiment of the present invention is designated generally at 10, and is shown attached to an overhead support member 12, to support a hanging plant 14. A second embodiment of the invention is designated generally at 10', and is shown supported on a handrail 16 with a pot holder attachment 18 removably attached to hanger 10'.

Hanger 10 includes a rigid generally vertical body 20 having upper and lower ends 22 and 24, respectively. Body 20 includes a generally planar rearward surface 26 in flush abutting contact with the forward vertical surface 12*a* of support member 12.

A hook member 28 is mounted to the upper end 22 of body 26, and includes a generally horizontal arm 30 and a depending leg 32. Arm 30 extends rearwardly from upper end 22, and includes a generally planar lower surface 32*a* in flush abutting contact with the top surface 12*b* of support member 12. Leg 32 depends from the rearward end of arm 30, and includes a generally planar forward surface 32*a* in flush abutting contact with the rearward surface 12*c* of support member 12.

In order to obtain flush abutting contact between rearward surface 26, lower surface 30*a* and forward surface 32*a* of body 20, arm 30 and leg 32, respectively, with the associated surfaces of support member 12, the distance between body 20 and leg 32 is only slightly greater than the width of support member 12 (as measured between forward surface 12*a* and rearward surface 12*c*). In this way, hanger 10 is stable once it is hooked on support member 12, yet is slidable to various positions along the support member.

Figure 3:
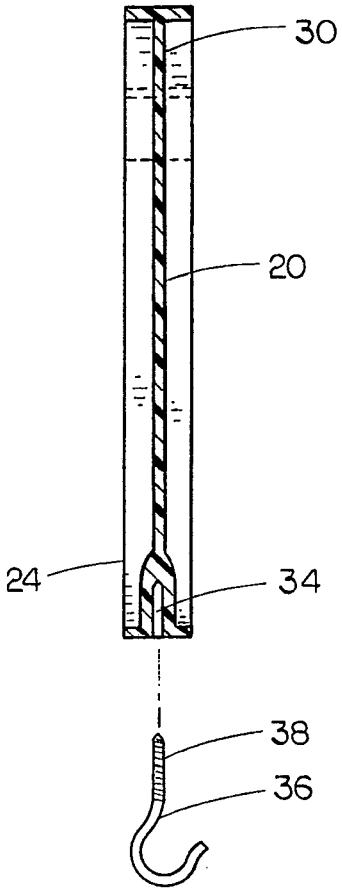
FIG. 3 is a sectional view taken at liens 3—3 in FIG. 2.
Figure 2:
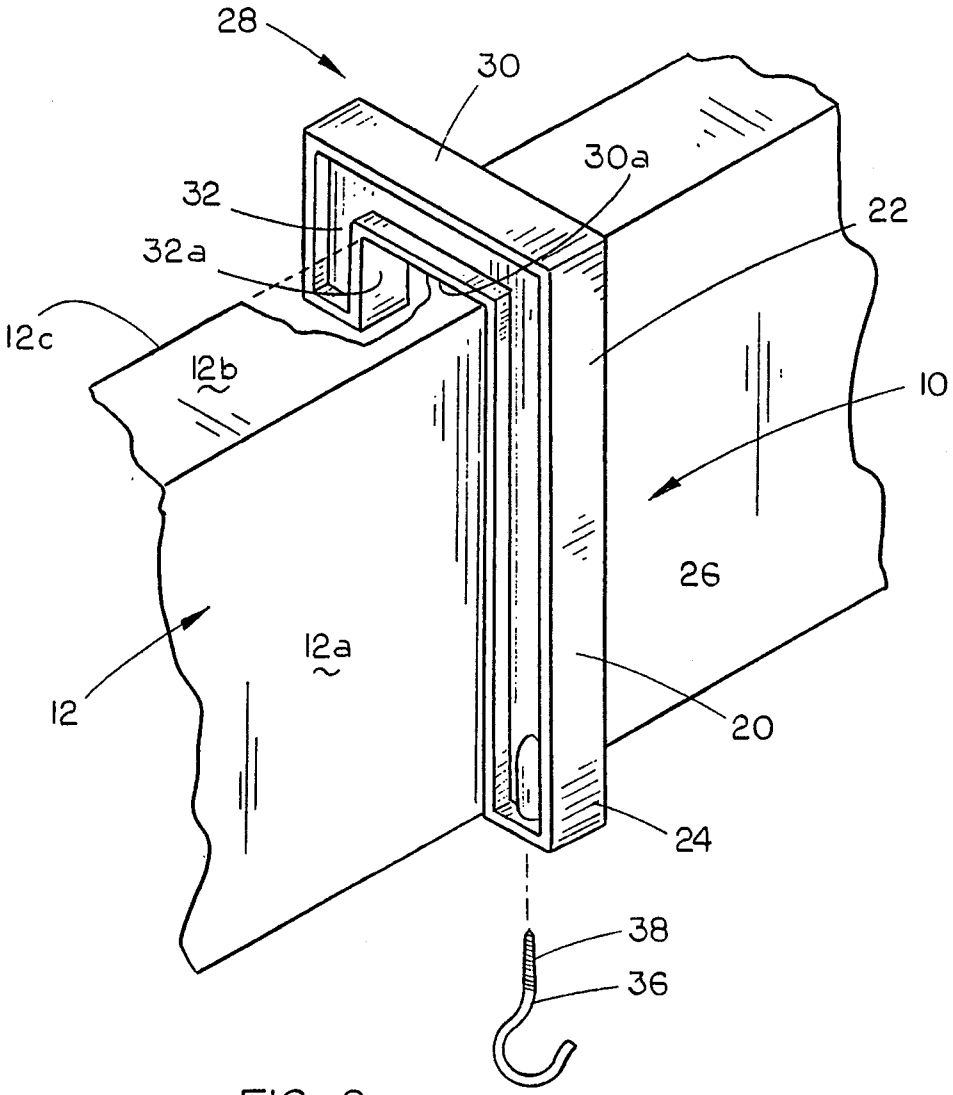
FIG. 2 is an enlarged perspective view of the first embodiment of the invention.

As shown in FIGS. 2 and 3, hanger 10 is manufactured from a rigid plastic material with an I-shaped cross-section. An interiorly threaded aperture 34 is formed in the lower end 24 of body 20 to receive a variety of support attachments. One such attachment is a conventional hook 36 having a threaded shank 38 designed for removable engagement in aperture 34. As shown in FIG. 1, hook 36 supports hanging plant 14.

Figure 4:
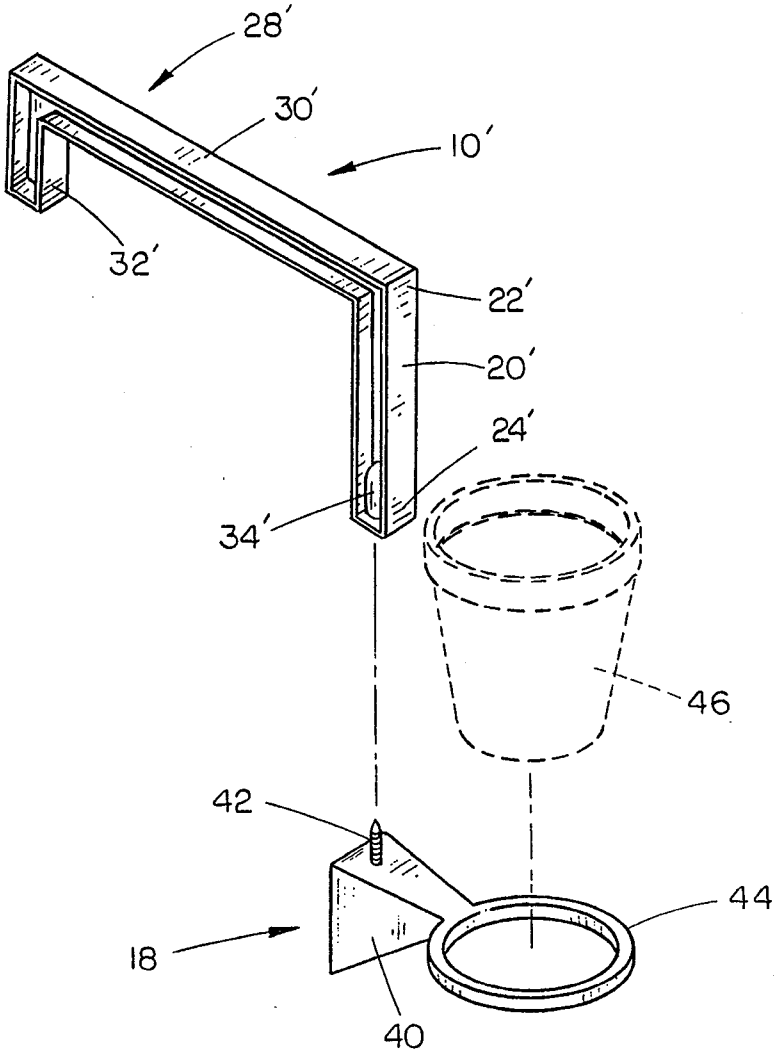
FIG. 4 is an enlarged perspective view of the second embodiment of the hanger.

A second embodiment of the invention is designated generally at 10' in FIGS. 1 and 4, and includes a generally vertical rigid body 20' with an arm 30' extending rearwardly from the upper end 22' of body 20'. A leg 32' depends from the rearward end of arm 30', to form a hook member 28' on the upper end of rigid body 20'. Hanger 10' is designed with a much longer arm 30' in order to snugly fit over the width of handrail 16, in a fashion similar to the first embodiment 10.

Pot holder attachment 18 includes a base 40 having an upwardly projecting threaded shaft 42 designed to engage aperture 34' in the lower end 24' of rigid body 20'. A horizontally oriented loop 44 is affixed to base 40 and is designed to support a flower pot 46, in a conventional fashion.

Figure 5:
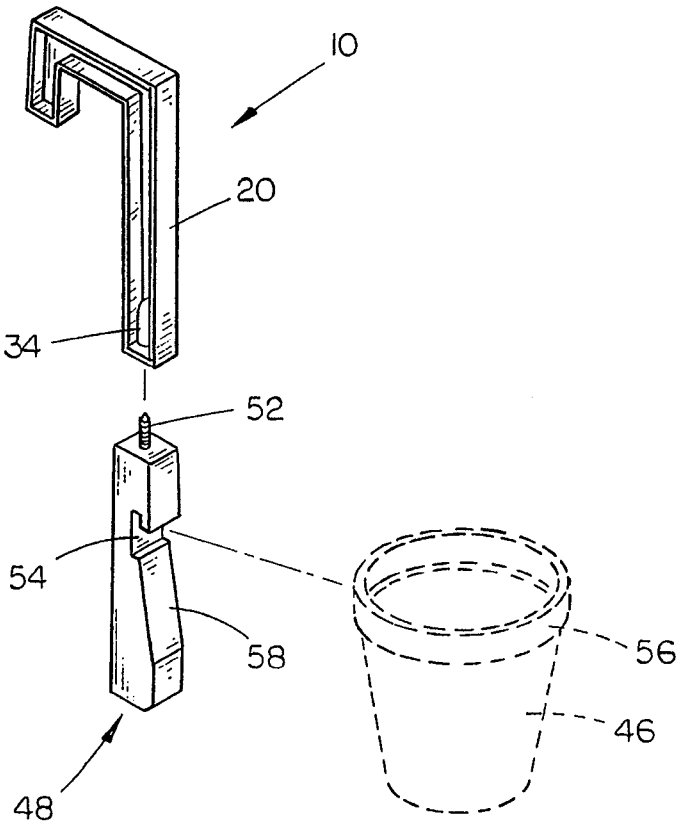
FIG. 5 is a perspective view of the first embodiment, with a different type of detachable support member.

FIG. 5 shows removable hanger 10 with a third support attachment 48 which is also designed to support a flower pot 46. Support attachment 48 includes a generally vertically oriented base 50 having an upwardly projecting threaded shaft 52 designed for removable engagement with threaded aperture 34 in rigid body 20. Base 50 includes a vertically oriented slot 54 designed to receive the annular rim 56 of flower pot 46. A sloped forward surface 58 on base 50 supports the slanted sides of flower pot 46.

Whereas the invention has been shown and described in connection with the preferred embodiments thereof, it will understood that many modifications, substitutions and additions may be made which are within the intended broad scope of the appended claims. For example, various other types of removable support attachments may be connected to hangers 10. Such attachments may be connected to hanger 10 in many ways, beyond the threaded shaft and threaded aperture arrangement shown herein. In addition, hanger 10 may be formed of various materials in various shapes so long as the hook portion on the upper end of the rigid body is designed to snugly fit the support member to prevent rotatable movement about the longitudinal axis of the support member to which the hanger is attached.

There has therefore been shown and described an improved removable hanger which accomplishes at least all of the above stated objects.

I claim:

1. A hanger for removable engagement with a support member comprising:

a rigid body having an upper end and a lower end;

said upper end including a hook portion for removable attachment to said support member;

said lower end including support means removably connected thereto, for supporting an article on said hanger;

said body lower end having a threaded aperture formed therein;

said support means including:

a base having an upwardly projecting threaded shaft removably engaged in said aperture; and a flower pot support means on said base.

2. The hanger of claim 1, wherein said hook portion includes an arm projecting rearwardly from the upper end of said body, and a leg depending from a rearward end of said arm, said arm mounted generally perpendicular to said body, and said leg mounted generally perpendicular to said arm.

3. In combination:

a support member having a forward vertical wall, a rearward vertical wall, an upper horizontal surface, and a lower horizontal surface; and a hanger removably engaged on said support member, comprising:

a rigid body having an upper end and lower end;

said upper end including a hook portion removably engaging said support member;

said lower end including a support means removably connected thereto for supporting an article on said hanger;

said body lower end having a threaded aperture formed therein;

said support means including:

a base having an upwardly projecting threaded shaft removably engaged in said aperture; and a flower pot support means on said base.

4. The combination of claim 3, wherein said flower pot support means includes a loop member mounted generally horizontally on said base, for supporting a flower pot rim.

5. The combination of claim 3, wherein said flower pot support means includes a generally vertically oriented slot formed in a forward face of said base for engaging a flower pot rim.

6. The combination of claim 3, wherein said hook portion includes an arm projecting rearwardly from the upper end of said rigid body and a leg depending from a rearward end of said arm, said arm mounted generally perpendicular to said body, and said leg mounted generally perpendicular to said arm.

7. In combination:

a support member having a forward vertical wall, a rearward vertical wall, an upper horizontal surface, and a lower horizontal surface;

a hanger removably engaged on said support member, comprising:

a rigid body having an upper end and lower end;

said upper end including a hook portion removably engaging said support member;

said lower end including a support means removably connected thereto for supporting an article on said hanger;

said body lower end having a threaded aperture formed therein; and said support means including:

a base having an upwardly projecting threaded shaft removably engaged in said aperture; and means on said base for supporting an object.

* * * * *